US008974093B2

(12) United States Patent
Wong

(10) Patent No.: US 8,974,093 B2
(45) Date of Patent: Mar. 10, 2015

(54) LIGHT CASING WITH MOVABLE PART

(76) Inventor: Tsui-Yun Wong, Taipei (TW)

( * ) Notice: Subject to any disclaimer, the term of this patent is extended or adjusted under 35 U.S.C. 154(b) by 177 days.

(21) Appl. No.: 13/438,512

(22) Filed: Apr. 3, 2012

(65) Prior Publication Data

US 2013/0258680 A1 Oct. 3, 2013

(51) Int. Cl.
*F21V 21/14* (2006.01)
*F21V 21/00* (2006.01)

(52) U.S. Cl.
USPC ..... 362/374; 362/147; 362/220

(58) Field of Classification Search
CPC ..... F21S 4/008; F21S 8/043; F21S 8/066; F21V 15/01; F21V 21/34; F21V 21/36
USPC ..... 362/145, 248, 374–375, 806, 220, 225, 362/217.07, 217.16, 217.14, 217.12, 147
See application file for complete search history.

(56) References Cited

U.S. PATENT DOCUMENTS 5,642,934 A * 7/1997 Haddad ..... 362/287
5,676,458 A * 10/1997 Shemitz et al. ..... 362/374
6,299,326 B1 * 10/2001 Andrus et al. ..... 362/373
7,357,538 B2 * 4/2008 Gaines et al. ..... 362/374
2007/0165396 A1 * 7/2007 Cunius ..... 362/127

OTHER PUBLICATIONS

U.S. Appl. No. 13/208,402, Tsui-Yun Wong.
U.S. Appl. No. 13/304,842, Tsui-Yun Wong.

* cited by examiner

*Primary Examiner* — Karabi Guharay
(74) *Attorney, Agent, or Firm* — Ming Chow; Sinorica, LLC

(57) ABSTRACT

A light casing has a semi-circular fixed case, a semi-circular movable case, and two lateral fastening members. Each of the lateral fastening members has a first surface, a second surface, and an orifice disposed near the center of the lateral fastening member. A semi-circular positioning slot is disposed on the periphery of the orifice on the second surface, and a nearly circular sliding slot is disposed on the periphery of the positioning slot on the second surface. The ends of the fixed case are disposed in the positioning slots, and at least one light is disposed on the fixed case. The ends of the movable case are disposed in the sliding slots. When the fixed case overlaps the movable case, the light is uncovered. When the fixed case and the movable case form a covered space, the light is covered.

10 Claims, 7 Drawing Sheets

LIGHT CASING WITH MOVABLE PART

BACKGROUND OF THE INVENTION

1. Field of the Invention

The invention relates to a light casing, particularly to a light casing that can be disposed on walls, beneath drain pipes, or under eaves. Users can open and close the light casing of the present invention in accordance with different contexts and preferences.

2. Description of the Prior Art

Traditionally, decorative lights are used only on specific holidays, such as Christmas or Independence Day. The repetitive cycle of loading, installing, unloading, packaging, and storing festival lights before and after holidays is an exhausting process to users. Furthermore, it may be dangerous when users install or unload the lights. For example, users may fall down when they are installing or unloading the lights on the roof.

The issues mentioned above have been problematic for consumers for a long time. Therefore, an adjustable light casing that can be adjusted based on the users' needs, does not need be unloaded after using, and is able to cover and protect lights inside would be the best solution to the problems.

SUMMARY OF THE INVENTION

The present invention provides a light casing that has two lateral fastening members connecting to a fixed case and a movable case. At least one light can be disposed on the fixed case, and the movable case can be moved to cover the light or expose the light based on users' needs.

The light casing of the present invention has two lateral fastening members, a fixed case, and a movable case. Each of the lateral fastening members has a first surface and a second surface. An orifice is disposed near the center of each of the lateral fastening members. A positioning slot is disposed on the periphery of the orifice on the second surface of each of the lateral fastening members. A sliding slot is disposed on the periphery of the positioning slot on the second surface of each of the lateral fastening members. The fixed case has an arc-shaped cross-section, a concave opening surface, a convex surface, and two opening ends. Each of the two opening ends of the fixed case is fixedly inserted in the positioning slot of one of the lateral fastening members. The movable case has an arc-shaped cross-section, a concave opening surface, a convex surface, and two opening ends. Each of the two opening ends of the movable case is movably inserted in the sliding slot of one of the lateral fastening members. When the movable case covers the convex surface of the fixed case, the concave opening surface of the fixed case is uncovered. When the movable case and the fixed case form a covered space, the concave opening surface of the fixed case is covered.

Preferably, the orifices of the lateral fastening members penetrate the first surface and the second surface of the lateral fastening members, whereas the positioning slots and the sliding slots do not penetrate the first surface of the lateral fastening members. Therefore, the movable case and the fixed case cannot penetrate the first surface of the lateral fastening members.

Preferably, the shape of positioning slots of the lateral fastening members is the same as the shape of the cross-section of the fixed case, and the size of the positioning slots is larger than or equal to the size of the two ends of the fixed case. Therefore, the opening ends of the fixed case can be fixedly disposed in the positioning slots of the lateral fastening members.

Preferably, a slightly semi-circular cylindrical portion extends between the positioning slot on the second surface of each of the two lateral fastening members and the orifice of each of the two lateral fastening members. The slightly semi-circular cylindrical portion has an aperture, and each of the two opening ends of the fixed case has an aperture, so the fixed case can be secured on the slightly semi-circular cylindrical portion through the apertures with a screw.

Preferably, the shape of the sliding slots of the two lateral fastening members is nearly circular, and each of the sliding slots has a first block portion and a second block portion. The shape of the cross-section of the movable case is close to semi-circular, and the size of the sliding slots is larger than the size of the two opening ends of the movable case. Therefore, the two opening ends of the movable case can be movably disposed in the sliding slots of the two lateral fastening members, and the movable case can be moved in between the first block portion and the second block portion of the sliding slot.

Preferably, each of the two lateral fastening members has an outer surface. A first arc-shaped positioning portion and a second arc-shaped positioning portion are disposed on the outer surface. Both the first arc-shaped positioning portion and the second arc-shaped positioning portion have at least one screw hole. The first arc-shaped positioning portion is nearly parallel with the positioning slot of the lateral fastening member, whereas the second arc-shaped positioning portion is nearly perpendicular to the positioning slot of the lateral fastening member.

Preferably, the light casing of the present invention further comprises at least one positioning base. The positioning base has a baseboard, an arm, and an arc-shaped plate. The baseboard has at least one aperture that allows the baseboard to be secured by a screw or bolt on a wall or ceiling, or under eaves. The arm has two ends. One end of the arm is disposed on the baseboard, and the other end of the arm is attached to the arc-shaped plate. The arc-shaped plate has at least one aperture that allows the arc-shaped plate to be secured by a screw or bolt on the first or the second arc-shaped positioning portions of the lateral fastening members, so the lateral fastening members can be secured on a wall or ceiling, or under eaves with the positioning base.

Preferably, the light casing of the present invention further comprises at least one middle-supporting member. The middle-supporting member has a first surface, a second surface, an orifice, a positioning slot, and a nearly circular sliding slot. The orifice is disposed near the center of the middle-supporting member. The positioning slot has the same shape as the fixed case and is disposed on the periphery of the orifice. The nearly circular sliding slot has a first block portion and a second block portion and is disposed on the periphery of the positioning slot. The orifice, the positioning slot, and the nearly circular sliding slot all penetrate the first and the second surface of the middle-supporting member. Therefore, the fixed case can be fixedly disposed through the positioning slot, and the movable case can be movably disposed thought the sliding slot and moved in between the first block portion and the second block portion of the sliding slot.

In another example, the light casing of the present invention has two lateral fastening members, at least one positioning base, a fixed case, and a movable case. Each of the lateral fastening members has a first surface, a second surface, an orifice, a nearly semi-circular positioning slot, and a nearly circular sliding slot. The orifice is disposed near the center of the lateral fastening member. The nearly semi-circular positioning slot is disposed on the periphery of the orifice on the second surface. The nearly circular sliding slot has a first block portion and a second block portion and is disposed on the periphery of the positioning slot on the second surface. The positioning base has two ends. One end attaches to one of the two lateral fastening members, and the other end can be secured on a well. The fixed case has a semi-circular cross-section, a concave opening surface, a convex surface, and two opening ends. The shape of the two ends of the fixed case is almost the same as the shape of the nearly semi-circular positioning slot. Each of the two opening ends of the fixed case is fixedly disposed in the nearly semi-circular positioning slot of one of the lateral fastening members. The movable case has a semi-circular cross-section, a concave opening surface, a convex surface, and two opening ends. Each of the two opening ends of the movable case is movably disposed in the nearly circular sliding slot of one of the lateral fastening members. When the first block portion blocks the movable case, the movable case covers the convex surface of the fixed case, and the concave opening surface of the fixed case is uncovered. When the second block portion blocks the movable case, the concave opening surface of the fixed case is covered by the movable case.

Preferably, each of the two lateral fastening members has an outer surface. A first arc-shaped positioning portion and a second arc-shaped positioning portion are disposed on the outer surface. Both the first and the second arc-shaped positioning portions have at least one screw hole. The positioning base has a baseboard, an arm, and an arc-shaped plate. The baseboard has at least one aperture that allows the baseboard to be secured by a screw or bolt on a wall or ceiling, or under eaves. The arm has two ends. One end of the arm is disposed on the baseboard, and the other end of the arm is attached to the arc-shaped plate. The arc-shaped plate has at least one aperture that allows the arc-shaped plate to be secured by a screw or bolt on the first or the second arc-shaped positioning portion of the lateral fastening members, so the lateral fastening members can be secured on a wall or ceiling, or under eaves with the positioning base.

DETAILED DESCRIPTION OF THE PREFERRED EMBODIMENT

The invention will be illustrated by way of the following examples, but the invention will not be limited thereto.

Figure 1:
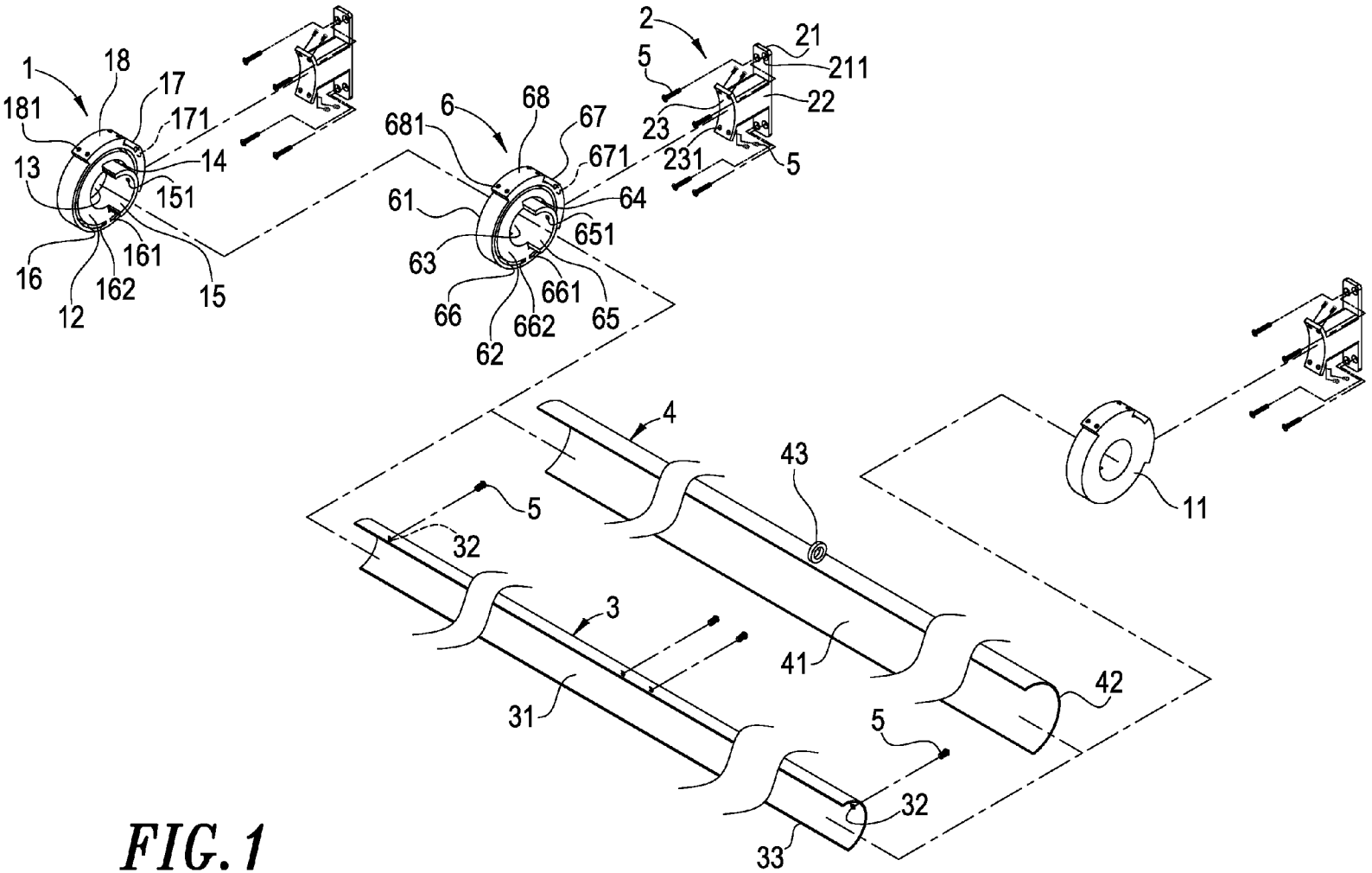
FIG. 1 is an exploded view of a light casing of the present invention.

Referring to the preferred embodiment of the invention as shown in FIGS. 1-4, specifically FIG. 1, a light casing of the present invention has two lateral fastening members 1, at least one middle-supporting member 6, at least one positioning base 2, a fixed case 3, and a movable case 4.

Figure 4:
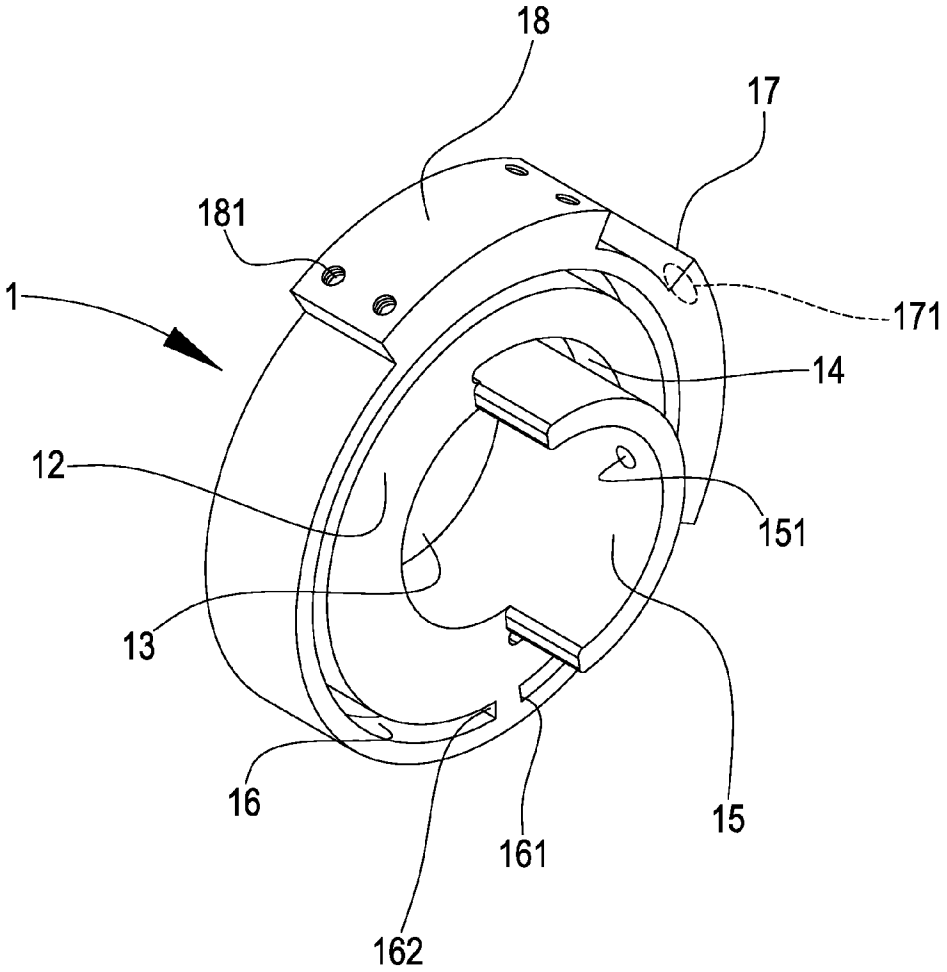
FIG. 4 is a perspective view of a lateral fastening member of the present invention.

As shown in FIG. 4, each of the two lateral fastening members 1 has a first surface 11, a second surface 12, and an orifice 13 disposed near the center of the lateral fastening member 1. The orifice 13 penetrates the first surface 11 and the second surface 12. A nearly semi-circular positioning slot 14 is disposed on the periphery of the orifice 13 on the second surface 12. A slightly semi-circular cylindrical portion 15 extends between the positioning slot 14 on the second surface 12 and the orifice 13. The cylindrical portion 15 has an aperture 151. A nearly circular sliding slot 16 is disposed on the periphery of the positioning slot 14 on the second surface 12. The sliding slot 16 has a first block portion 161 and a second block portion 162. The lateral fastening member 1 has an outer surface, and a first arc-shaped positioning portion 17 and a second arc-shaped positioning portion 18 are disposed on the outer surface. Both the first arc-shaped positioning portion 17 and the second arc-shaped positioning portion 18 have at least one screw hole 171, 181. The first arc-shaped positioning portion 17 is nearly parallel with the positioning slot 14, and the second arc-shaped positioning portion 18 is nearly perpendicular to the positioning slot 14. The positioning slot 14 and the sliding slot 16 do not penetrate the first surface 11 of the lateral fastening member 1.

As shown in FIG. 1, the middle-supporting member 6 has a first surface 61 and a second surface 62. An orifice 63 is disposed near the center of the middle-supporting member 6. A nearly semi-circular positioning slot 64 is disposed on the periphery of the orifice 63. A slightly semi-circular cylindrical portion 65 extends between the positioning slot 64 and the orifice 63. The cylindrical portion 65 has an aperture 651. A nearly circular sliding slot 66 is disposed on the periphery of the positioning slot 64. The sliding slot 66 has a first block portion 661 and a second block portion 662. The middle-supporting member 6 has an outer surface, and a first arc-shaped positioning portion 67 and a second arc-shaped positioning portion 68 are disposed on the outer surface. Both the first arc-shaped positioning portion 67 and the second arc-shaped positioning portion 68 have at least one screw hole 671, 681. The first arc-shaped positioning portion 67 is nearly parallel with the positioning slot 64, and the second arc-shaped positioning portion 68 is nearly perpendicular to the positioning slot 64.

As shown in FIG. 1, the positioning base 2 has a baseboard 21, an arm 22, and an arc-shaped plate 23. The baseboard 21 has at least one aperture 211 that allows the baseboard 21 to be secured by a screw or a bolt 5 on a wall or ceiling, or under eaves. The arm 22 has two ends, one end of the arm 22 is disposed on the baseboard 21, and the other end of the arm 22 is attached to the arc-shaped plate 23. The arc-shaped plate 23 has at least one aperture 231, which corresponds to the screw hole 171, 181, 671, 681 on the arc-shape positioning portion 17, 18, 67, 68. The arc-shaped plate 23 can be attached to the first arc-shaped positioning portion 17, 67 or the second arc-shaped positioning portion 18, 68. Therefore, the lateral fastening member 1 and the middle-supporting member 6 can be secured by a screw or a bolt 5 with the positioning base 2 on a wall or ceiling, or under eaves with the positioning base.

As shown in FIG. 1, the fixed case 3 has a nearly semi-circular cross-section, a concave opening surface 31, a convex surface, and two opening ends 33. At least one aperture 32 is disposed near the two opening ends 33 of the fixed case 3. The shape of the two opening ends 33 is the same as the shape of the positioning slot 14 of the lateral fastening member 1, and the size of the two opening ends 33 of the fixed case 3 is smaller than or equal to the size of the positioning slots 14, 64 of the lateral fastening member 1 and the middle-supporting member 6. Therefore, the two opening ends 33 of the fixed case 3 can be inserted into the nearly semi-circular positioning slots 14, 64, and cannot be moved in the positioning slots 14, 64. The two opening ends 33 of the fixed case 3 can be attached to the slightly semi-circular cylindrical portions 15, 65 of the lateral fastening members 1 and the middle-supporting member 6, and the apertures 32 of the fixed case 3 correspond to the aperture 151 of the slightly semi-circular cylindrical portion 15. Hence, the opening ends 33 of the fixed case 3 can be secured in the positioning slots 14 of the lateral fastening members 1 by screws or bolts 5 through the apertures 151, 32. The opening ends 33 of the fixed case 3 is blocked by the first surfaces 11 of the lateral fastening members 1 and cannot penetrate the first surfaces 11.

Figure 2:
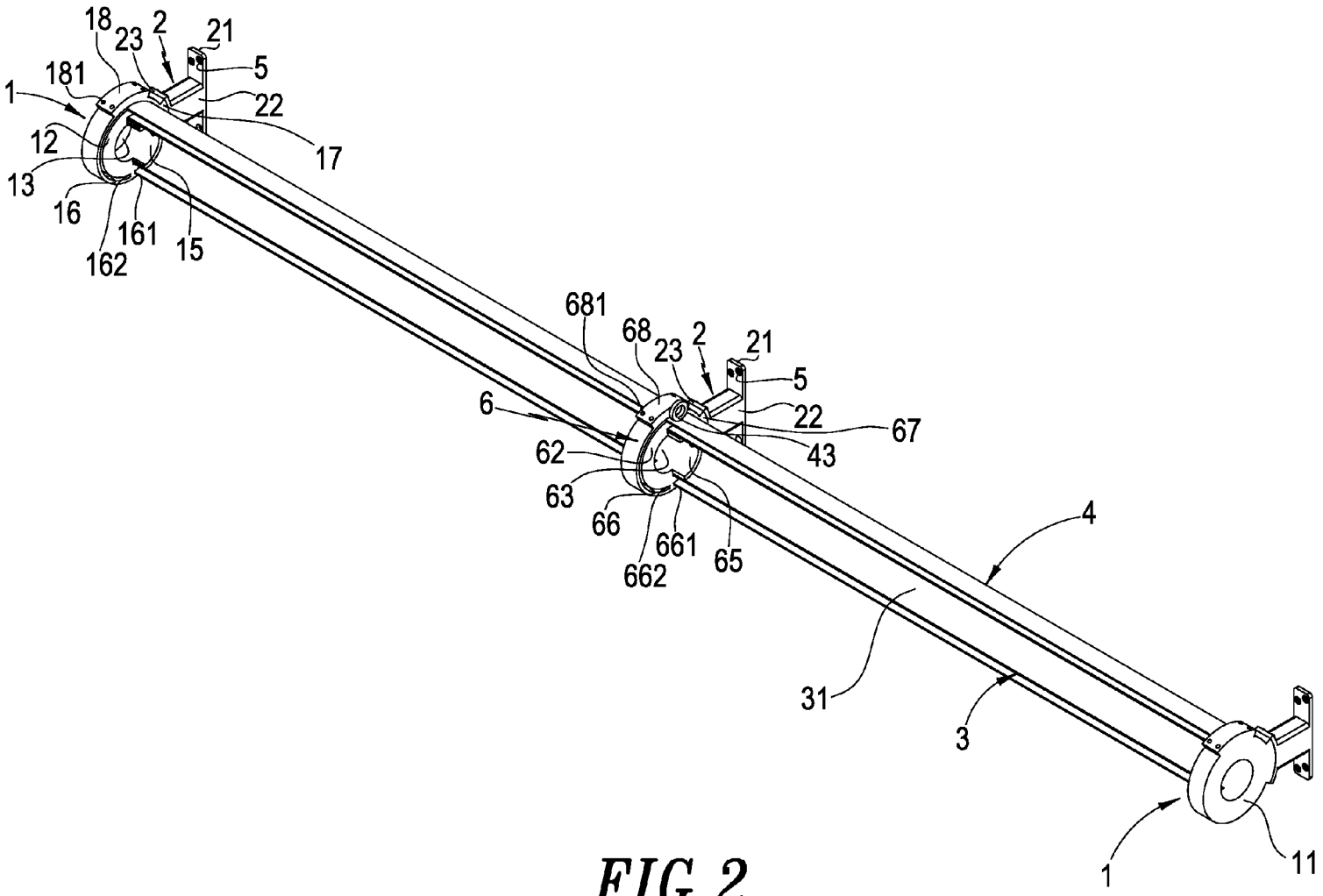
FIG. 2 is a perspective view of the light casing when the light casing is opened.
Figure 3:
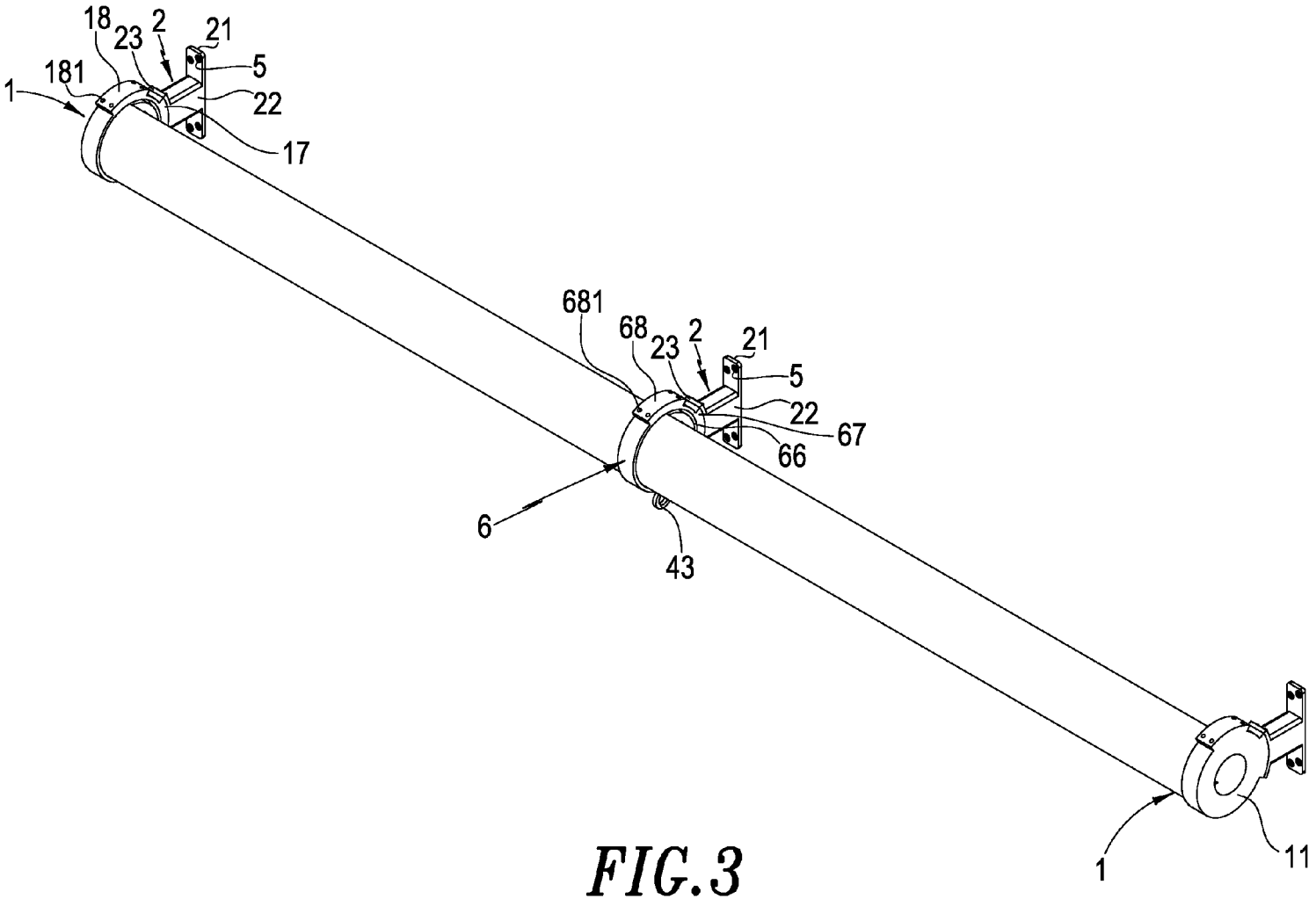
FIG. 3 is a perspective view of the light casing when the light casing is closed.

As shown in FIG. 1, the movable case 4 has a nearly semi-circular cross-section, a concave opening surface 41, a convex surface, and two opening ends 42. The sizes of the sliding slots 16, 66 of the lateral fastening member 1 and the middle-supporting member 6 are larger than the size of the two opening ends 42 of the movable case 4. Therefore, the two opening ends 42 of the movable case 4 can be inserted in the sliding slots 16 of the lateral fastening members 1, and the movable case 4 can be moved stably in the sliding slots 16, 66. The two opening ends 42 of the movable case 4 are blocked by the first surfaces 11 of the lateral fastening members 1 and cannot penetrate the first surfaces 11. As shown in FIGS. 1 and 2, when the movable case 4 is blocked by the first block portions 161, 661 of the lateral fastening members 1 and the middle-supporting member 6, the movable case 4 covers the convex surface of the fixed case 3, so the concave opening surface 31 of the fixed case 3 is uncovered. As shown in FIGS. 1 and 3, when the movable case 4 is blocked by the second block portions 162, 662 of the lateral fastening members 1 and the middle-supporting member 6, the movable case 4 covers the concave opening surface 31 of the fixed case 3.

Additionally, as shown in FIG. 1, a ring 43 is disposed near the middle of the movable case 4, and users can open and close the movable case 4 through the ring 43 with a hook.

When the fixed case 3 and the movable case 4 are long, a plurality of middle-supporting members 6 can be used to support the fixed case 3 and the movable case 4.

Figure 5:
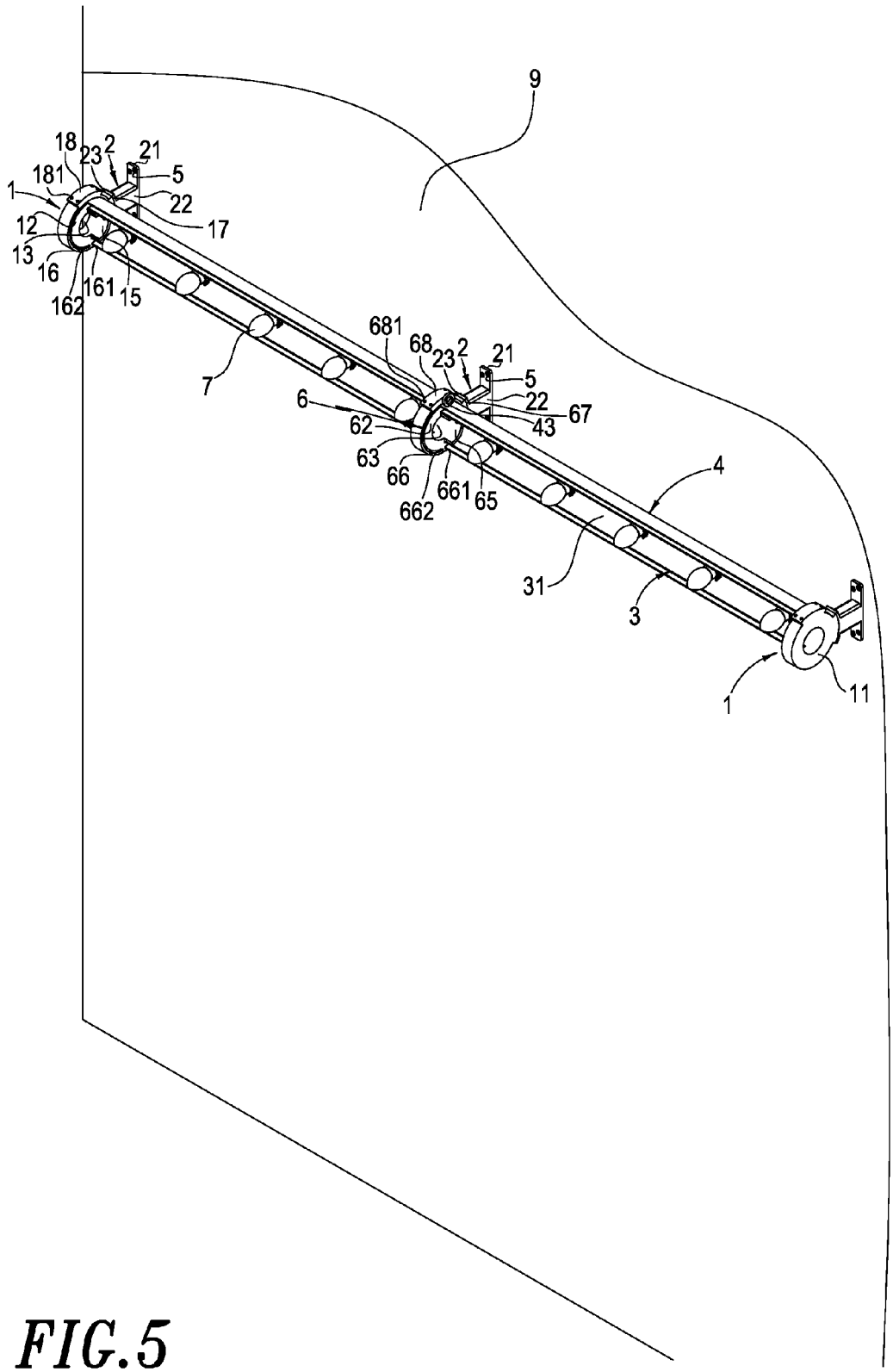
FIG. 5 is a perspective view of the light casing combining with lights and secured on a wall.
Figure 6A:
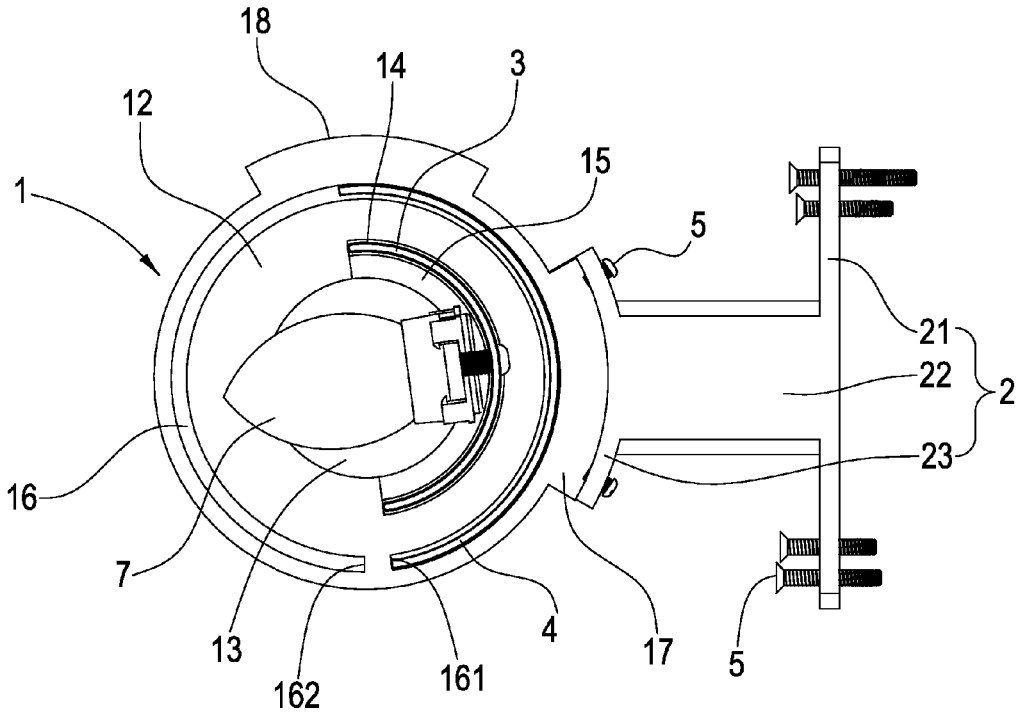
FIGS. 6A and 6B are side views of the light casing when in use.
Figure 6B:
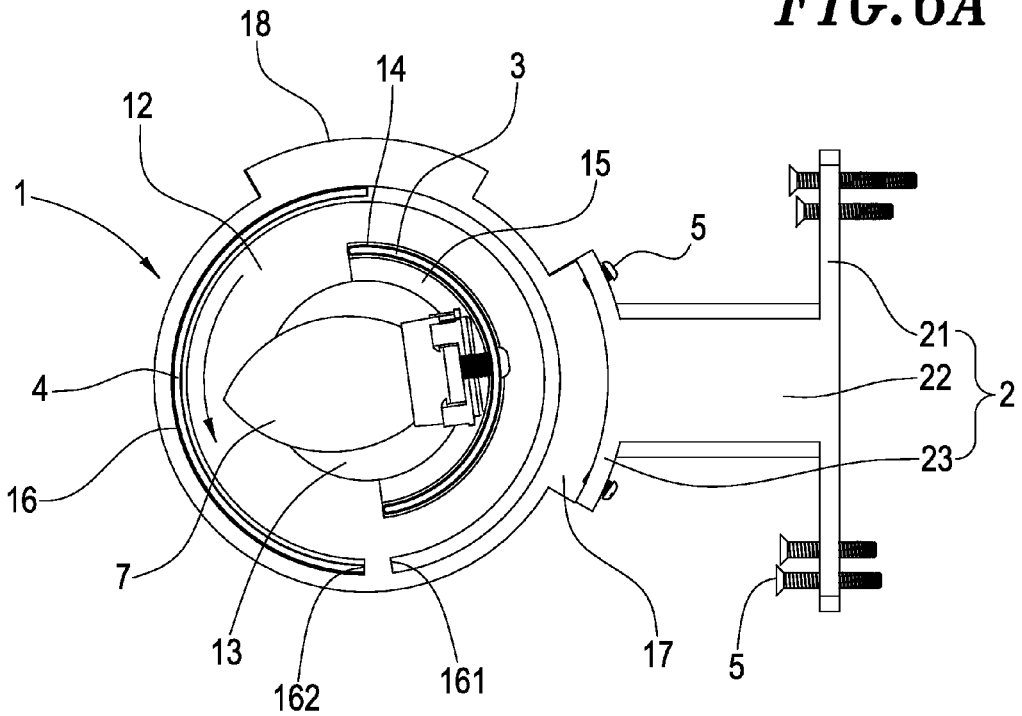

Referring to FIGS. 5, 6A, and 6B, at least one light 7 is secured on the concave opening surface 31 of the fixed case 3 of the light casing and emits light from the concave opening surface 31. The lights 7 can be, but not limited to, decoration lights, Christmas light bulbs, neon lights, LED lights, or fluorescent lamps.

Referring to FIGS. 5, 6A, 6B, and 7, when the baseboards 21 of the positioning bases 2 are secured on a wall 9, and the arc-shaped plates 23 of the positioning bases 2 are fasten to the first arc-shaped positioning portions 17, 67 of the lateral fastening members 1 or the middle-supporting member 6, the two lateral fastening members 1, the middle-supporting member 6, the movable case 4, and the fixed case 3 are held on the wall 9. When the baseboards 21 of the positioning bases 2 are secured under eaves 10 or on the ceiling, then the arc-shaped plates 23 of the positioning bases 2 are fasten to the second arc-shaped positioning portions 18, 68 of the lateral fastening members 1 or the middle-supporting member 6, so the two lateral fastening members 1, the middle-supporting member 6, the movable case 4, and the fixed case 3 are held under eaves 10 or on the ceiling. Therefore, fixed case 3 of the light casing of the present invention can be horizontally or vertically disposed on walls, beneath drain pipes, or under eaves based on users' needs.

When the lights 7 are on, the movable case 4 is placed at the position that covers the convex surface of the fixed case 3 and is blocked by the first block portions 161, 661 of the sliding slots 16, 66 of the lateral fastening members 1 and the middle-supporting member 6, so the concave opening surface 31 of the fixed case 3 and the light emitted from the lights 7 are uncovered. When the lights 7 are off, the movable case 4 is moved to cover the fixed case 3 and is blocked by the second block portions 162, 662 of the sliding slots 16, 66 of the lateral fastening members 1 and the middle-supporting member 6, so the lights 7 are protected in the covered space formed by the fixed case 3 and the movable case 4.

Figure 7:
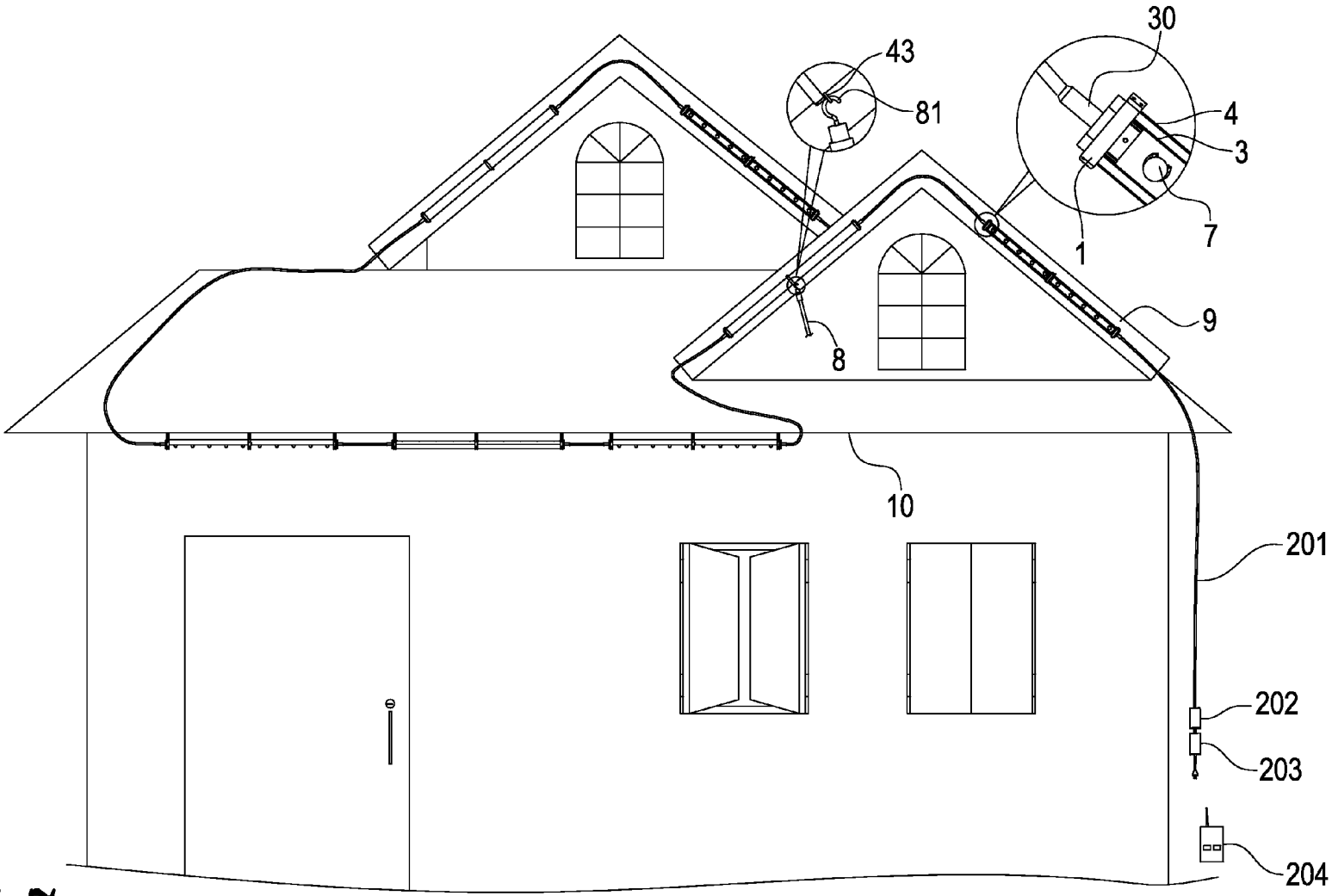
FIG. 7 is a perspective view of the light casing for use in one embodiment of the present invention.

Additionally, as shown in FIG. 7, in order to connect the lights 7 to a controller 202 and a transformer 203, a power cable 201 is disposed at one end of the lateral fastening members 1. The power cable 201 connects to the lights 7 through the orifices 13 of the lateral fastening members 1. Additionally, a connector 30 can be disposed at one end of the lateral fastening members 1 to connect other lights 7 and a plurality of light casings of the present invention.

Additionally, as shown in FIG. 7, a remote controller 204 optionally controls the lights 7. The controller 202 receives the signals send from the remote controller 204, so the lights 7 can be controlled remotely. Therefore, the light casing of the present invention can be used with different lights and controlling modes based on the users' needs.

Additionally, when the movable case 4 covers the concave opening surface 31 of the fixed case 3, part of the movable case 4 overlaps the fixed case 3, so water and dust cannot get into the light casing of the present invention.

Additionally, when the lights 7 are not used, users do not need to unload and store the lights 7 because the lights 7 are covered and protected by the fixed case 3 and the movable case 4 of the light casing of the present invention. Therefore, it is very convenient to use decoration lights with the light casing of the present invention.

Additionally, as shown in FIG. 7, when the light casing of the present invention is disposed at a high position, a rod 8 with a hook 81 can be hooked to the ring 43 of the movable case 4 to open and close the movable case 4.

Accordingly, comparing to known technologies, the present invention provides the following technical features and advantages with novelty, improvement, and industrial use.

1. Disposed in the light casing of the present invention, decoration lights do not need to be repeatedly installed or unloaded. When users want to use the decoration lights, users only need to open the light casing of the present invention.
2. The light casing of the present invention can be connected and disposed in different ways based on different types, sizes, and structures of houses.
3. The light bulbs disposed in the light casing of the present invention can be replaced individually without replacing all the decoration lights.
4. The light casing of the present invention covers the lights inside to keep them clean when the lights are not used, so the users do not need to clean the lights often.
5. The light casing of the present invention protects the lights inside from wind, sunlight, and water, and therefore extends the lifespan of the lights.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A light casing, comprising:

two lateral fastening members, each lateral fastening member having a first surface, a second surface, and an orifice disposed near the center of the lateral fastening member, a positioning slot disposed on the periphery of the orifice on the second surface, and a sliding slot disposed on the periphery of the positioning slot on the second surface;

a fixed case having an arc-shaped cross-section, a concave opening surface, a convex surface, and two opening ends, and each of the two opening ends of the fixed case fixedly disposed in the positioning slot of one of the lateral fastening members; and a movable case having an arc-shaped cross-section, a concave opening surface, a convex surface, and two opening ends, and each of the two opening ends of the movable case movably disposed in the sliding slot of one of the lateral fastening members; and wherein when the movable case covers the convex surface of the fixed case, the concave opening surface of the fixed case is uncovered, and when the fixed case and the movable case form a covered space, the concave opening surface of the fixed case is covered by the movable case.

2. The light casing of claim 1, wherein the orifices of the two lateral fastening members penetrate the first surfaces and the second surfaces of the two lateral fastening members, and the positioning slots and the sliding slots of the two lateral fastening members do not penetrate the first surfaces of the two lateral fastening members, so the fixed case and the movable case cannot penetrate the first surfaces of the two lateral fastening members.

3. The light casing of claim 1, wherein the shape of the positioning slots of the two lateral fastening members is the same as the shape of the cross-section of the fixed case, and the size of the positioning slots is larger than or equal to the size of the two opening ends of the fixed case, so the two opening ends of the fixed case can be fixedly disposed in the positioning slots of the two lateral fastening members.

4. The light casing of claim 3, wherein a semi-circular cylindrical portion extends between the positioning slot on the second surface of each of the two lateral fastening members and the orifice of each of the two lateral fastening members, the semi-circular cylindrical portion has an aperture, and each of the two opening ends of the fixed case has an aperture, so the fixed case can be secured on the semi-circular cylindrical portion through the apertures with a screw or a bolt.

5. The light casing of claim 1, wherein the shape of the sliding slots of the two lateral fastening members is circular, each of the sliding slots has a first block portion and a second block portion, the shape of the cross-section of the movable case is semi-circular, and the size of the sliding slots is larger than the size of the two opening ends of the movable case, so the two opening ends of the movable case can be movably disposed in the sliding slots of the two lateral fastening members, and the movable case can be moved in between the first block portion and the second block portion of the sliding slot.

6. The light casing of claim 1, wherein each of the two lateral fastening members has an outer surface, and a first arc-shaped positioning portion and a second arc-shaped positioning portion disposed on the outer surface, both the first arc-shaped positioning portion and the second arc-shaped positioning portion have at least one screw hole, the first arc-shaped positioning portion is parallel with the positioning slot of the lateral fastening member, and the second arc-shaped positioning portion is perpendicular to the positioning slot of the lateral fastening member.

7. The light casing of claim 6, further comprising at least one positioning base having a baseboard, an arm, and an arc-shaped plate, wherein the baseboard has at least one aperture that allows the baseboard to be secured by a screw or a bolt on a wall or ceiling, or under eaves, the arm has two ends, one end of the arm is disposed on the baseboard, the other end of the arm is attached to the arc-shaped plate, the arc-shaped plate has at least one aperture that allows the arc-shaped plate to be secured by a screw or a bolt on the first arc-shaped positioning portion or the second arc-shaped positioning portion of the lateral fastening members, so the lateral fastening members can be secured on a wall or ceiling, or under eaves with the positioning base.

8. The light casing of claim 1, further comprising at least one middle-supporting member having a first surface, a second surface, an orifice disposed near the center of the middle-supporting member, a positioning slot having the same shape as the fixed case and disposed on the periphery of the orifice, a circular sliding slot having a first block portion and a second block portion and disposed on the periphery of the positioning slot, wherein the orifice, the positioning slot, and the circular sliding slot penetrate the first and the second surface of the middle-supporting member, so the fixed case can be fixedly disposed through the positioning slot, and the movable case can be movably disposed thought the sliding slot and moved in between the first block portion and the second block portion of the sliding slot.

9. A light casing, comprising:

two lateral fastening members, each lateral fastening member having a first surface, a second surface, and an orifice disposed near the center of the lateral fastening member, a semi-circular positioning slot disposed on the periphery of the orifice on the second surface, and a circular sliding slot having a first block portion and a second block portion and disposed on the periphery of the semi-circular positioning slot on the second surface;

at least one positioning base having two ends, one end attached to one of the two lateral fastening members, the other end can be secured on a wall;

a fixed case having an semi-circular cross-section, a concave opening surface, a convex surface, and two opening ends, the shape of the two opening ends of the fixed case being almost the same as the shape of the semi-circular positioning slot, and each of the two opening ends of the fixed case fixedly disposed in the semi-circular positioning slot of one of the two lateral fastening members; and a movable case having an semi-circular cross-section, a concave opening surface, a convex surface, and two opening ends, each of the two opening ends of the movable case movably disposed in the sliding slot of one of the two lateral fastening members, wherein when the first block portion blocks the movable case, the movable case covers the convex surface of the fixed case, and the concave opening surface of the fixed case is uncovered, and when the second block portion blocks the movable case, the concave opening surface of the fixed case is covered by the movable case.

10. The light casing of claim 9, wherein each of the two lateral fastening members has an outer surface, and a first arc-shaped positioning portion and a second arc-shaped positioning portion disposed on the outer surface, both the first and the second arc-shaped positioning portions have at least one screw hole, and the at least one positioning base has a baseboard, an arm, and an arc-shaped plate, the baseboard has at least one aperture that allows the baseboard to be secured by a screw or a bolt on a wall or ceiling, or under eaves, the arm has two ends, one end of the arm is disposed on the baseboard, the other end of the arm is attached to the arc-shaped plate, the arc-shaped plate has at least one aperture that allows the arc-shaped plate to be secured by a screw or a bolt on the first arc-shaped positioning portion or the second arc-shaped positioning portion of the lateral fastening members, so the lateral fastening members can be secured on a wall or ceiling, or under eaves with the positioning base.

* * * * *